United States Patent [19]

Lott

[11] 4,296,284

[45] Oct. 20, 1981

[54] FLEXIBLE SHIELD FOR HIGH VOLTAGE DISCONNECT SWITCH

[75] Inventor: Donald L. Lott, Portland, Oreg.

[73] Assignee: Siemens-Allis, Inc., Atlanta, Ga.

[21] Appl. No.: 106,720

[22] Filed: Dec. 26, 1979

[51] Int. Cl.[3] ..... H01H 31/00; H01H 9/00

[52] U.S. Cl. ..... 200/48 R; 200/48 KB; 200/304

[58] Field of Search ..... 200/48 R, 48 KB, 302, 200/304

[56] References Cited

U.S. PATENT DOCUMENTS

| | | | |
|---|---|---|---|
| 1,808,555 | 6/1931 | Ishimaru | 200/48 R |
| 1,832,721 | 11/1931 | Miller | 200/48 KB |
| 2,179,539 | 11/1939 | Bowie | 200/48 R |
| 2,421,718 | 6/1947 | Schultz | 200/304 |
| 3,076,063 | 1/1963 | Prace et al. | 200/302 |
| 3,579,836 | 5/1971 | Kraus | 33/125 C |
| 3,780,249 | 12/1973 | Harper | 200/302 |

FOREIGN PATENT DOCUMENTS

| | | | |
|---|---|---|---|
| 112111 | 12/1940 | Australia | 200/48 KB |

*Primary Examiner*—John W. Shepperd

*Attorney, Agent, or Firm*—Frederick W. Powers, III

[57] ABSTRACT

A shielding arrangement for preventing the buildup of ice on the contacts of an outdoor high-voltage switch structure. The shield includes one or more flexible members which overlie the contacts and are in the path of the travel of a switch element.

10 Claims, 3 Drawing Figures

FLEXIBLE SHIELD FOR HIGH VOLTAGE DISCONNECT SWITCH

BACKGROUND OF THE INVENTION

The present invention relates generally to outdoor, high voltage switches and more specifically to shielding means for high voltage disconnect switches.

High voltage tranmission line systems are necessarily provided with switching means for connecting or disconnecting the transmission lines from a load, or to a source of power. The switching means commonly takes the form of a power circuit breaker which is adapted to automatically break a circuit when a fault is sensed, and a disconnect switch connected in series between the circuit breaker and the line. Unlike a circuit breaker a disconnect switch, (as the term is used herein) is ordinarily not adapted to break a "live" circuit, wherein a substantial current must be interrupted. Ordinarily, interruption of high currents requires apparatus such as a power circuit breaker. However, in order to allow maintenance work on power transmission lines and apparatus, it is frequently necessary to isolate the apparatus after the current-carrying circuit has been interrupted. Hence the need for isolating switching means of the type described herein. Such switches are frequently located in enclosed areas such as power stations and substations, and often operated in groups. Due to the high electrostatic potentials involved, the switches are commonly large in size, and mounted on elaborate insulators. Further, the physical configuration of the working parts of the switch is extremely critical owing to the extremely high electrostatic fields in which they operate.

Disconnect switches commonly comprise a moveable blade or arm of considerable length controlled by linkage which may be operated manually, or by electric, pnuematic or hydraulic means. Ordinarily the elements of the switch are exposed, the moveable blade portion being pulled free of engagement with the stationary portion and swinging through a large arc to effect opening of the switch.

Due to the outdoor location of the disconnect switches, and to their necessarily exposed design, they are susceptible to jamming due to ice, freezing rain and the like. Considerable effort has been expended to design switching mechanisms which will shed ice readily. Effort have been made to provide the element with surfaces of polytetrafluoroethylene and similar substances to minimize the adhesion of ice. However, frequently the ice simply encases the elements and is mechanically secured to them despite the relatively low adhesion of ice to the surfaces.

Other efforts have been made to devise switches which would fracture a coating of ice as they separate, however, considerably increased force is still needed to separate the frozen elements. It will therefore be appreciated that it would be highly advantageous to provide means for preventing a buildup of ice upon the working elements of a high voltage disconnect switch.

It is therefore an object of the present invention to provide shielding means that does not unduly interfere with the electrostatic field about a high voltage disconnect switch, yet eliminates an ice buildup thereon.

Another object of the invention is to provide means for keeping accumulated ice from a high voltage disconnect switch without interfering with the operation thereof.

Yet another object is to provide means for preventing ice from accumulating upon working parts of a switch, and for shedding the accumulated ice in response to operation of the switch.

SUMMARY OF THE INVENTION

Briefly stated, in accordance with one aspect of the invention the foregoing objects are achieved by providing a rigid, upstanding support which extends generally vertically alongside the stationary member of a disconnect switch. Extending generally horizontally from the support means is a generally planar shield formed of a flexible synthetic material. The rigid support means supports the flexible shield at some distance above the stationary portion of the switch, directly in the path of a moveable switch blade. Accordingly, ice and the like is shielded from the area in which the moveable and stationary switch portions engage, and as the moveable portion is disengaged it encounters and deflects the flexible shield to break the accumulated ice therefrom.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawing in which:

DESCRIPTION OF A PREFERRED EMBODIMENT

Figure 1:
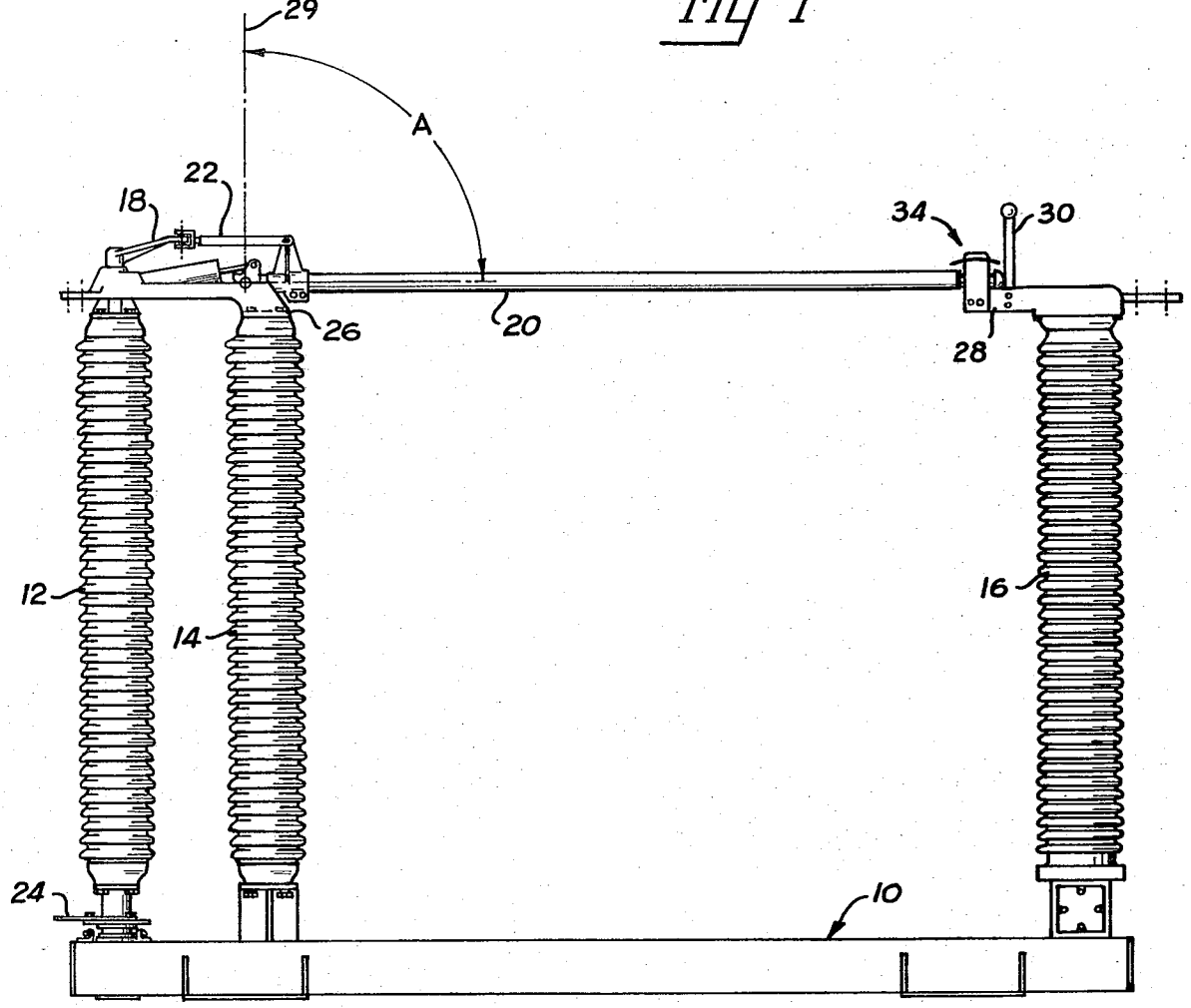
FIG. 1 is an elevational view of disconnect switch making use of the present invention.

FIG. 1 depicts a disconnect switch of the type under consideration, disposed upon a base generally indicated at 10, which may be formed of structural aluminum or galvanized steel members. Mounted upon base 10 are a set of three insulating columns 12, 14 and 16. The columns provide both physical support and electrical isolation for the switching apparatus which surmounts them. In particular, an operating linkage including a rotatable arm 18 is coupled to the moveable element of the switch, herein termed a blade and designated 20, by means of a link 22. Arm 18 is coupled by a rod extending longitudinally through column 12 and is connected at its bottom and to another arm 24. Blade 20 and the linkage are supported by, and pivot on, a support element 26 which may be a casting or the like and is bolted to the upper ends of columns 12 and 14.

Column 16 is surmounted by assemblage of stationary components including a stationary switch section 28 which receives the free end of blade 20. An arc horn 30 extends upwardly from member 28, generally adjacent the path traversed by the free end of blade 20. A shield assembly generally shown at 34 is mounted on the stationary element 28 and overlies the free end of blade 20, as will be more fully explained hereinafter.

In order to operate the switch, a lateral force is applied to arm 24. The force may originate in a mechanical, electrical, pneumatic or hydraulic actuator, or may be manually applied through crank or lever system. The source of power for operating the switch forms no part of the present invention, however, and it will be recognized by those skilled in the art that various operating mechanisms may be selected depending upon the application and size of the switch, and other parameters.

Rotation of arm 24 effects a similar movement of upper arm 18, which pulls upon link 22 so as to first twist blade 20 about its longitudinal axis in order to free it from stationary member 28, then draws blade 20 upwardly along arc A to a free position generally indicated by dotted line 29. As blade 20 moves upwardly, its extreme end generally follows arc horn 30 so that an electrical arc, if drawn, follows upwardly along the arc horn and extension. Further as the free end of blade 20 rises it interferes with a portion of shield assembly 34, as will be described hereinafter, and deflects that portion as it passes. Ultimately the free end of the blade clears the uppermost end of the arc horn 30 and the arc is terminated, whereupon the switched circuit is opened.

Figure 2:
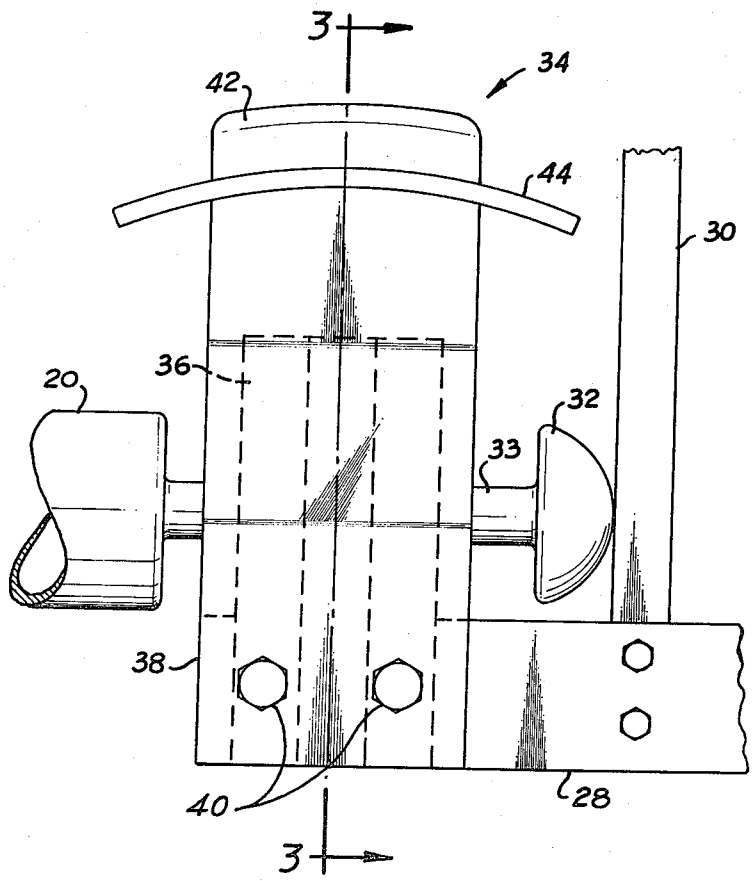
FIG. 2 is an enlarged view of a portion of FIG. 1.

Turning now to FIG. 2, an enlarged view of shield assembly 34 is shown. The stationary portion 28 of the disconnect switch is illustrated in part, along with the upwardly-extending arc horn 30. Blade 20 is shown in a closed position, its extreme end 32 extending in contact to arc horn 30, and an intermediate portion 33 resting between sets of contact fingers 36 which are illustrated by dotted lines. The contact fingers are located within a shield support 38, which extends upwardly from stationary member 28 and is secured thereto by bolts 40. A second support member similar to support 38 is disposed at the far side of stationary member 28, but it is not visible in the Figure. The support member has a cap 42 secured thereto, and captured between the cap and the support is a generally planar shield 44. As shown, the shield extends generally horizontally above the interengaged portion of blade 20 and stationary switch member 28. Shield 44 is preferably secured in a curved or arcuate configuration, to better shed rain and snow, and lessen an ice buildup thereon. Further, cap 42 is provided with generous radii to lessen the effect of corona discharge occuring due to the high electrostatic fields which are prevalent about switching equipment of the type depicited.

Figure 3:
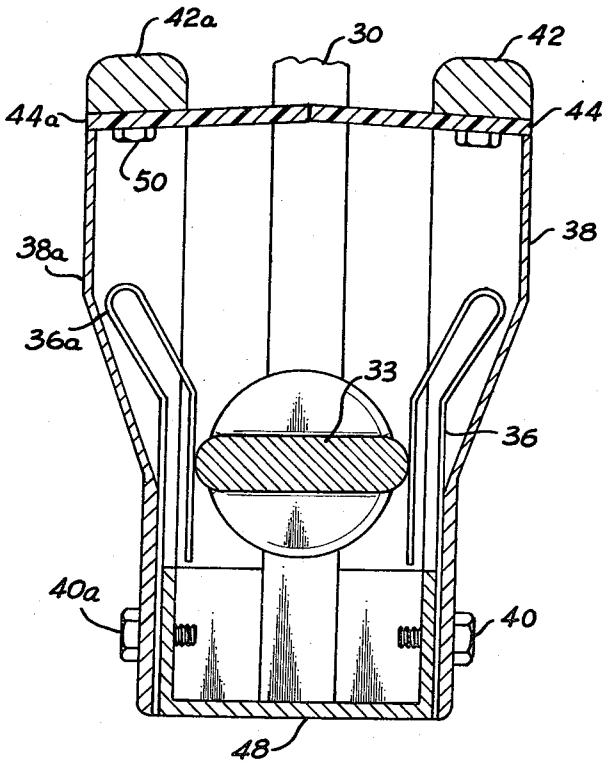
FIG. 3 is a section taken along 3—3 of FIG. 2.

In FIG. 3 there is shown a sectional view of the apparatus taken along 3—3 of FIG. 2. It will be seen that the intermediate section 33 of blade 20 exhibits a generally oval configuration, tightly wedging itself between sets of conductive contact fingers 36 and 36*a*. The contact fingers are secured to a structural member 48 which forms a portion of the stationary switch member 28 by bolts 40 and 40(*a*), which bolts further serve to locate supports 38 and 38*a* substantially as shown.

The contact finger 36 and 36*a* which secure the blade of the switch in place may be made from a suitable conductive material such copper or the like. The construction may be conventional, or may be optimized without regard to the need for shedding ice buildup owing to the shielding provided by the present invention.

In particular, flexible shields 44 and 44*a* are attached to support 38, 38*a* and extend generally horizontally toward each other. The confronting edges of the shields meet at a point generally above blade 20, and along the path to be traveled by the blade as it opens. In a preferred embodiment, the shields are formed of a synthetic material such as urethane and are of sufficient thickness so that they may project horizontally without drooping. Further, in depicited embodiment the flexible shield are supported by capturing them between vertical supports 38, 38*a* and corresponding caps 42, 42*a* which are held in place by bolts 50 or the like. The supports and caps may be made from many suitable materials, but in a preferred embodiment are made made of aluminum and are provided with generous radii, as described hereinabove.

It will now be understood that due to the overlying relationship of the urethane shields, freezing precipitation builds up upon them and does not reach the interengaged switch members beneath them. Accordingly, the initial disengagement of the switch members does not require any more force than normal nor does it place any additional stress upon the switch members. Once the blade 20 is disengaged from the spring members 36, 36*a* and the blade begins to rise, it deflects the urethane shields upwardly as it passes between them. Due to the flexible nature of the shields and to the relatively low adhesion of frozen ice to their surfaces, they yield readily and the ice buildup is easily fractured and broken loose by the passage of the blade. Similarly, upon closing should any ice buildup be present it will be broken away as the blade descends toward the stationary portion of the switch.

It will now be seem that there has been provided means for shielding the engaging members of a high voltage disconnect switch from a build up of ice or the like, yet without interfering with the operation of the switch. Further, the shield produces no undue effects upon the electrostatic field about the switch and has the advantages of economy, simplicity and adaptability to various switch designs. It will be evident from the foregoing description that certain aspects of the invention are not limited to the particular details of the example illustrated and it is therefore contemplated that other modifications or applications will occur to those skilled in the art. It is accordingly intended that the appended claims shall cover all such modifications and applications as do not depart from the true spirit and scope of the invention.

What is claimed as new and the desired to be secured by Letters Patent of the United States is:

1. Ice shielding means for an outdoor, high voltage disconnect switch assembly having interengaging moveable and stationary members, comprising:

rigid support means coupled to the stationary portion of the switch and extending generally vertically therefrom;

flexible shielding means having one side thereof fixedly coupled to said support means and aside opposite said one side free and unsupported so as to extend above the stationary portion of the switch and in the path of the moveable portion thereof;

whereby movement of the moveable portion of the switch pursuant to disengagement of the switch members temporary elastically deforms the shielding means.

2. The invention defined in claim 1, wherein said support means comprise a pair of rigid supports coupled to opposite sides of the stationnary switch member.

3. The invention defined in claim 1, wherein said support means comprise a pair of rigid supports adapted to be coupled upon opposite side of the stationary switch member.

4. The invention defined in claim 3, wherein said flexible shield means comprise generally planar members of synthetic material, each of said shield means coupled to one of said rigid support means and extending toward one another, said shield means having confronting edges disposed at a position generally above the stationary portion of the switch assembly.

5. The invention defined in claim 4, wherein the confronting edges of said flexible shielding means is substantially in the path of travel of the moveable portion of the switch.

6. The invention defined in claim 5, wherein said rigid supports comprise a first, lower member bolted to the rigid portion of the switch, and second, upper member, said flexible shielding means being encaptured between said upper and lower members, and fastening means extending between said upper and lower members to secure said members together.

7. In a high voltage disconnect switch of the outdoor type and including a stationary and a moveable interengaging switch portion, an ice shielding means comprising;

a rigid support member coupled to said stationary portion of said switch and extending generally vertically therefrom;

a flexible shield means coupled to and supported by said rigid support member and extending generally horizontally therefrom above the point of engagement of said moveable and stationary members of said switch;

said flexible shield means extending in the path of said moveable member of the switch.

8. The invention defined in claim 7, wherein said rigid support member comprises a pair of supports extending vertically from opposite sides of the stationary portion of the switch.

9. The invention defined in claim 8, wherein said flexible shield means comprises a pair of generally planar members of synthetic material, each being supported by ones of said rigid members, and extending toward one another to confront one another substantially above the intersection of the moveable and stationary portions of the switch.

10. The invention defined in claim 9, wherein said flexible shield members intersect at a point substantially along the path of the moveable portion of the switch.

* * * * *